US011939097B2

(12) United States Patent
Rütten et al.

(10) Patent No.: US 11,939,097 B2
(45) Date of Patent: Mar. 26, 2024

(54) METHOD AND DEVICE FOR ATTACHING CARRYING HANDLES TO PACKAGING MEANS OR GROUPS OF PACKAGING MEANS

(71) Applicant: KHS GmbH, Dortmund (DE)

(72) Inventors: Thomas Rütten, Kranenburg (DE); Simon Uphues, Kleve (DE)

(73) Assignee: KHS GmbH, Dortmund (DE)

( * ) Notice: Subject to any disclaimer, the term of this patent is extended or adjusted under 35 U.S.C. 154(b) by 268 days.

(21) Appl. No.: 17/639,712

(22) PCT Filed: Sep. 9, 2020

(86) PCT No.: PCT/EP2020/075197

§ 371 (c)(1),
(2) Date: Mar. 2, 2022

(87) PCT Pub. No.: WO2021/048205

PCT Pub. Date: Mar. 18, 2021

(65) Prior Publication Data

US 2022/0289417 A1 Sep. 15, 2022

(30) Foreign Application Priority Data

Sep. 13, 2019 (DE) ..... 102019124665.2

(51) Int. Cl.
*B65B 61/06* (2006.01)
*B65B 17/02* (2006.01)
(Continued)

(52) U.S. Cl.
CPC ..... *B65B 61/14* (2013.01); *B65B 17/025* (2013.01); *B65B 21/00* (2013.01); *B65B 41/18* (2013.01); *B65B 59/001* (2019.05)

(58) Field of Classification Search
CPC ..... B65B 61/14; B65B 61/06
See application file for complete search history.

(56) References Cited

U.S. PATENT DOCUMENTS 4,415,399 A * 11/1983 Geisinger ..... B29C 69/005 156/518
5,458,726 A * 10/1995 Castoldi ..... B65B 61/14 156/355
(Continued)

FOREIGN PATENT DOCUMENTS

AU 6799598 A 11/1998
CN 101352932 A 1/2009
(Continued)

OTHER PUBLICATIONS

International Search Report, PCT Application No. PCT/EP2020/075197, dated Dec. 18, 2020 (3 pages).

*Primary Examiner* — Gloria R Weeks
(74) *Attorney, Agent, or Firm* — Occhiuti & Rohlicek LLP

(57) ABSTRACT

A handle applicator includes controller that receives signals concerning marks on an endless band. The controller controls a contact body to be between a release position, in which a handle applicator is freely driven and a drawing position, in which the contact body contacts the endless band of material prior to its being cut to form the handle. The contact body moves along a continuum of positions between the release position and the drawing position based on actual position data indicative of actual positions of position markings on the handle.

19 Claims, 11 Drawing Sheets

(51) Int. Cl.

| | |
|---|---|
| ***B65B 21/00*** | (2006.01) |
| ***B65B 41/18*** | (2006.01) |
| ***B65B 59/00*** | (2006.01) |
| ***B65B 61/14*** | (2006.01) |

(56) References Cited

U.S. PATENT DOCUMENTS

| | | | | |
|---|---|---|---|---|
| 6,234,230 | B1 * | 5/2001 | Petitjean | B65B 61/14 156/565 |
| 7,191,576 | B2 * | 3/2007 | Talou | B65B 61/14 53/64 |
| 11,577,873 | B2 * | 2/2023 | Stuhlmann | B65B 61/06 |
| 2003/0101685 | A1 * | 6/2003 | Jansen | B65B 61/14 53/134.1 |

FOREIGN PATENT DOCUMENTS

| | | | |
|---|---|---|---|
| CN | 105555669 | A | 5/2016 |
| CN | 205652482 | U | 10/2016 |
| CN | 106660727 | A | 5/2017 |
| DE | 3715445 | A1 | 11/1988 |
| DE | 20207217 | U1 | 8/2002 |
| DE | 102011015343 | A1 | 10/2012 |
| DE | 102017107356 | A1 | 10/2018 |
| DE | 102018118043 | A1 | 1/2020 |
| EP | 0560699 | A1 | 9/1993 |
| EP | 1312551 | A1 | 5/2003 |
| IL | 88537 | A | 3/1991 |
| WO | 2016157042 | A1 | 10/2016 |

* cited by examiner

METHOD AND DEVICE FOR ATTACHING CARRYING HANDLES TO PACKAGING MEANS OR GROUPS OF PACKAGING MEANS

RELATED APPLICATIONS

This is the national stage of international application PCT/EP2020/075197, filed on Sep. 9, 2020, which claims the benefit of the Sep. 13, 2019 priority date of German application DE 10 2019 124 665.2, the contents of which are incorporated herein by reference.

FIELD OF INVENTION

The invention relates to an apparatus and method for attaching carrying handles to packages or groups of packages.

BACKGROUND

It is often the case that one forms bundles made of containers. This is carried out by shrink wrapping or by using an adhesive to connect the containers to each other. Such a practice helps make transport easier, protects the goods themselves against damage or loss, improves presentation at a store, and therefore promotes sales.

A handle attached to such bundles has been found to promote sales. Such handles are often plastic bands that are self-adhesive on one side. The central portion of the adhesive side is protected by paper so that the customer's hand does not stick to it. The distal portions are exposed so that they can bond to the bundle.

Adhesive bands as described are advantageous for manufacturing since the band can easily be cut to length without worrying about the location of the adhesive.

SUMMARY

The object of the present invention is therefore to provide a device and method for the attachment of carrying handles to packaging means of groups of packaging means which are largely improved in relation to the prior art as described, which do not exhibit disadvantages of the prior art and which, in particular, allow for simple format adjustment to different lengths and attachment heights of a carrying handle.

According to a first aspect, the invention relates to a device for the attachment of carrying handles to packaging means or groups of packaging means by means of the packaging means or groups of packaging means being conveyed on a transport device in a transport direction being able in each case to be provided with a carrying handle, wherein the carrying handle is configured preferably as a self-adhesive carrying handle. For this purpose the device comprises a basic body and a carrying handle applicator unit, which can be driven by a motor, and which is mounted such that it can be driven by means of the transport device about a horizontal axis of rotation lying transverse to the transport direction. The device further comprises contact body mounted on the basic body and capable of being moved, which interacts with the carrying handle applicator unit. Also provided is a detection unit, by means of which position marks of the carrying handles can be detected. In this situation, the carrying handle applicator unit comprises at least three applicator arms, oriented radially to the axis of rotation, which in each case extend along a longitudinal axis which intersects the axis of rotation and is oriented away from it, and formed at which in each case is at least one holding and/or pressing device, as well as a cutting tool, such that an endless band, provided or capable of being provided at least in sections with an adhesive layer, can be conveyed in each case over a packaging means or a group of packaging means, from which a carrying handle can be separated, in each case with an adhesive section on the free end side, and the carrying handle formed in such a way can be applied to the packaging means or groups of packaging means, in particular by being pressed on. According to the invention, the respective holding and/or pressing device comprises at least one suction region for the at least temporary holding and/or guiding of the endless band and of the carrying handle separated from this, by means of a negative pressure which can at least temporarily be produced. The contact body is in this situation adjustable between a release position and a drawing position, wherein, in the release position, the carrying handle applicator unit can be freely driven, and in the drawing position of the contact body, when in appropriate operation, can be brought in contact at least temporarily with the upper side of the uncut carrying handle. In this context, uncut means that the carrying handle coming from the dispensing unit as endless material has not yet been cut upstream of the carrying handle applicator unit.

According to the invention, provision is made for the contact body to be configured in such a way that it can be moved as a dependency of actual position data, detected by means of the at least one detection unit of the position marks, in multiple steps and in particular steplessly, between the release position and the drawing position, by means of an electrical drive device.

Advantageously, the contact body can therefore be moved to, or adopt, any desired intermediate position between the release position and the drawing position, as an at least temporarily permissible operational position, and can therefore, also during the operation of the device, in the event of length changes of the carrying handle, such as stretch in the carrying handle, change the desired depth position as a drawing position in the respective movement section, i.e. the penetration depth of the contact body into the carrying handle, as a dependency of the actual control data acquired, and can therefore carry out subsequent regulating.

According to one advantageous embodiment variant, provision can be made in this situation that, by means of the contact body, any desired intermediate position can be moved to, between the release position and the drawing position, as an at least temporarily permissible operating position.

According to a further advantageous embodiment variant, provision can be made in this situation that the electrical drive device is configured such that, by means of a control and evaluation device, the electrical drive device can be controlled and/or regulated as a function of actual position data of the position marks of the carrying handles, detected by means of the detection unit, in order for the contact body to be moved in multiple steps, and in particular steplessly, between the release position and the drawing position.

According to a further advantageous embodiment variant, provision can be made in this situation that the electrical drive device is configured as an electric motor drive, in particular as a stepping motor, and for particular preference as a servomotor.

According to a further advantageous embodiment variant, provision can be made in this situation that the at least one detector device is configured as an optical detector device, in particular as a video camera, which has a detection range by means of which the respective actual position of a position mark can be detected on a corresponding carrying handle (4) as actual position data.

According to a further advantageous embodiment variant, provision can be made in this situation that the device in configured in such a way as to detect, in the fixed-position detection area, actual position data of a corresponding carrying handle by means of the detector device, and, by means of an electronic evaluation device deposited in the electronic control and evaluation device, to compare these with reference position data stored there of position marks for carrying handles, and to generate from any possible deviation a control signal, in order to actuate the electrical drive device by means of the electronic control and evaluation device, which in turn arranges for an adjustment of the contact body (8) between the release position and the drawing position, required due to the deviation between the actual position data and the reference position data.

According to a further advantageous embodiment variant, provision can be made in this situation that the contact body is provided on the drive device such as to be rotatable by means of a lever arm, wherein the lever arm extends at an angle away from the drive device in the direction of the contact body in such a way that, in the release position of the contact body, the applicator arms can be guided past it in a freely rotatable manner.

According to a further advantageous embodiment variant, provision can be made in this situation that the electrical drive device is configured for producing a linear movement of the contact body, particularly advantageously a linear pivot movement of the contact body.

According to a further advantageous embodiment variant, provision can be made in this situation that the pivot movement of the contact body is configured in a synchronous movement to the rotation movement of the applicator arms of the carrying handle applicator unit.

According to a further advantageous embodiment variant, provision can be made in this situation that the at least one suction region of the respective holding and/or pressing device of the corresponding applicator arm is configured as movable by means of a movement device along the assigned longitudinal axis. Particularly advantageously in this situation, therefore, the device according to the invention is configured such as to carry out in a simple manner, a format adaptation to carrying handles of different lengths, as well as to different attachment heights of a carrying handle, in that, due to the movement capacity of the suction regions by means of the movement device, the relative distance interval between two suction regions provided at adjacent applicator arms and the relative distance interval of the suction regions to the transport plane are changeable, and therefore can be adjusted to the respective length of a carrying handle taken up between them and/or to the attachment height.

According to another further advantageous embodiment variant, provision can be made in this situation that the respective suction region of a corresponding applicator arm is configured as movable by means of the movement device between a first length and a second length over a movement path.

According to another further advantageous embodiment variant, provision can be made in this situation that the respective holding and/or pressing device, with its at least one suction region formed at it, of the corresponding applicator arm, is configured such as to be movable by means of the movement device along the assigned longitudinal axis.

According to another further advantageous embodiment variant, provision can be made in this situation that the corresponding applicator arm comprises in each case a first arm element and a second arm element which in each case can be moved along the associated longitudinal axis relative to the first arm element, wherein the respective holding and/or pressing device, with its at least one assigned suction region, is assigned to the respective second arm element.

According to another further advantageous embodiment variant, provision can be made in this situation that the respective second arm element is configured as movable between a retracted and/or extended position relative to the associated first arm element by means of the movement device, in such a way that the corresponding applicator arm, in its retracted position, exhibits the second length, and in its extended position exhibits the first length.

According to another further advantageous embodiment variant, provision can be made in this situation that the respective second arm element is configured as to be continuously movable, by means of the movement device, between the retracted and extended position, such that the corresponding applicator arm can be operated in all intermediate positions between the first length and the second length.

According to another further advantageous embodiment variant, provision can be made in this situation that the movement device comprises at least one right-angle gear device, as well as a threaded section gear device, in order to convert a rotating drive movement initiated on a drive shaft of the angle gear device into a translational displacement movement, produced by means of the worm gear device, of the respective second arm elements.

According to another further advantageous embodiment variant, provision can be made in this situation that provision is made, adjacent to the respective bend section, for a contact element, which can be changed and/or replaced in the direction of rotation and perpendicular extension to the side surface of the applicator arm and/or in the height of the side surface of the applicator arm. This contact element can comprise in each case a suction device for holding and/or fixing a carrying handle by means of negative pressure. In this situation, a part surface of the next carrying handle lies on the contact surface of the contact element, and can be temporarily fixed there. Advantageously, this lowest end position of the contact body is arranged at a distance interval from the contact element, such that the carrying handle can be drawn and/or tensioned in the lower movement segment of the contact body over the contact element, and, if required, can be guided and held by suction in end positions of different depths.

According to another further advantageous embodiment variant, provision can be made in this situation that the corresponding suction device provided between two applicator arms can be subjected, depending on its position, in particular its rotational position, at least temporarily to at least one negative pressure level and/or overpressure level.

According to another further advantageous embodiment variant, provision can be made in this situation that the corresponding suction device is configured such as to be movable by means of a further movement device perpendicular to the axis of rotation DA and/or parallel to the corresponding longitudinal axis.

According to another further advantageous embodiment variant, provision can be made in this situation that the relative distance interval of the respective suction device to the axis of rotation DA, and/or the relative distance interval to the suction region provided on the face side at the corresponding applicator arm, are adjustable.

According to a further aspect, the invention relates to a method for attaching carrying handles to packaging means or groups of packaging means, with which the packaging means or groups of packaging means. conveyed on a transport device in a transport direction, are provided in each case with at least one self-adhering carrying handle, with which an endless band, provided at least in sections with an adhesive layer, is conveyed in each case over a packaging means or a group of packaging means, from which a carrying handle is separated, in each case with an adhesive section on the free-end side, and the carrying handle formed in this way is pressed onto the packaging means or the group of packaging means, and which is characterized in that the carrying handle is applied to the packaging means or the group of packaging means by means of a device according to the invention. If required, before the pressing procedure an adhesive is applied on at least one part region of the carrying handle and/or the respective contact surface.

"Packaging means" in the meaning of the invention are also packages or containers which are usually used in the foodstuffs sector, and in this situation in particular also in the beverage sector, and specifically containers, such as bottles, cans, and also soft packages, for example such as are produced from card and/or plastic film and/or metal film, transport containers, such as bottle crates, etc. "Groups of packaging means" in the meaning of the invention are packaging means which are assembled to form groups, such as bundles of such packaging means.

The expression "essentially" or "approximately" signifies in the meaning of the invention deviations from the exact value in each case by up to +/−10%, preferably by up to +/−5%, and/or deviations in the form of changes which are not of significance for the function.

Further configurations, advantages, and possible applications of the invention also derive from the following description of exemplary embodiments and from the Figures. In this situation, all the features described and/or represented as images are in principle the object of the invention, individually or in any combination, regardless of their relationship in the claims or reference to them. The contents of the claims are also deemed to be constituent parts of the description.

Although some aspects have been described in connection with a device, it is understood that these aspects also represent a description of the corresponding method, such that a block element or a structural element of a device is also to be understood as a corresponding method step or as a feature of a method step. By analogy with this, aspects which have been described in connection with, or as, a method step, also represent a description of a corresponding block or detail or feature of a corresponding device. Some or all of the method steps can be carried out by a hardware apparatus (or with the use of a hardware apparatus), such as, for example, a microprocessor, a programmable computer, or an electronic circuit. With some exemplary embodiments, some or many of the most important method steps are carried out by such an apparatus.

The invention is described in greater detail hereinafter on the basis of the Figures in relation to exemplary embodiments. The Figures show:

Identical reference numbers are used in the Figures for elements of the invention which are the same or have the same effect. Moreover, for the sake of easier overview, only reference numbers are represented in the individual Figures which are required for the description of the respective Figure. The invention is also represented in the Figures only in schematic views in order to explain the mode of operation. In particular, the representations in the Figures serve only to explain the underlying principle of the invention. For the sake of easier overview, the representation of all the component parts of the device has been deliberately avoided, since these are known from the prior art.

DETAILED DESCRIPTION

Figure 1A:
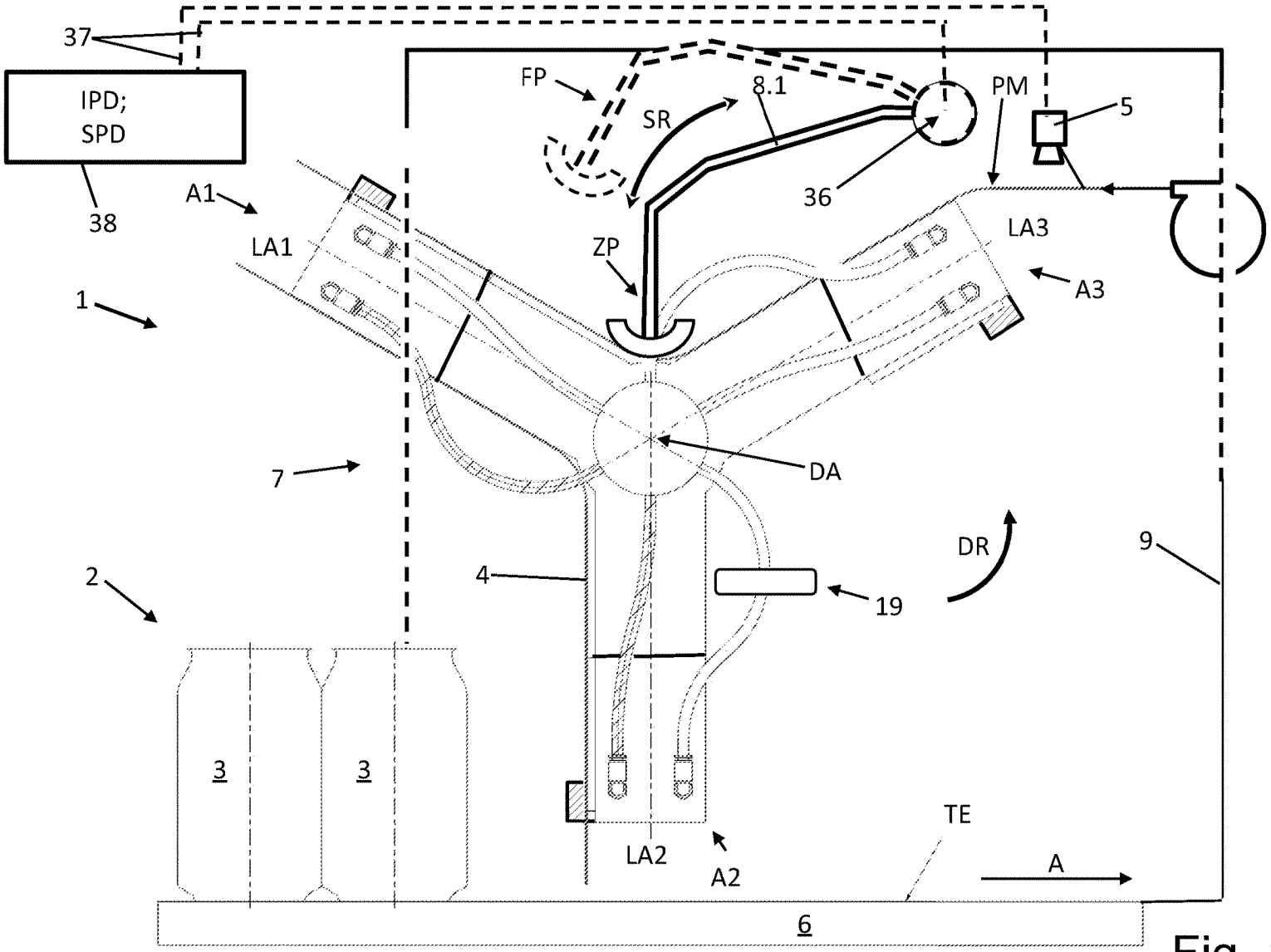
FIGS. 1*a* and 1*b* show embodiments of a handle-attaching machine.

FIG. 1*a* shows a handle-attaching machine 1 that attaches handles 4 to bundles 2. Such handles 4 make it possible to conveniently carry the bundle 2.

Examples of carrying handles 4 include carrying loops. The handle 4 is secured by its ends to opposite sides of the bundle 3, for example by welding or adhesive bonding. A suitable material for the handle 4 is plastic. Preferably, the handle 4 is self-adhesive.

A bundle 2 comprises one or more containers 3. Examples of bundles 2 include those with four containers 3 that form two rows of two containers 3 each. The containers 3 are connected to each other to form a stable bundle 2, for example by shrink film or by adhesive.

The handle-attaching machine 1 is arranged above a transporter 6 on a basic body 9. The containers 3, which are arranged in bundles 2, stand upright on a transport plane TE as the transporter 6 conveys them along a transport direction "A." In FIG. 1*a*, the transport direction "A" is from left to right. The handle-attaching machine 1 attaches the handle 4 as the bundle moves to the right.

The handle-attaching machine 1 includes a motor-driven handle applicator 7 that draws a length of band from a band store. It does so at a speed that matches the handle applicator's rotation.

The handle applicator 7 cuts the band to the proper length to make a handle 4. The handle applicator 7 then attaches the ends of the handle 4 to the bundle 2.

In FIG. 1*a*, the handle applicator 7 rotates counterclockwise in a rotation direction DR about a horizontal rotation axis DA that is transverse to the transport direction "A" and parallel to the transport plane TE. The handle applicator's height above the transport plane TE is adjustable. This permits adjustment of the distance between the rotation axis DA and the transport plane TE.

The handle applicator 7 comprises first, second, and third arms A1, A2, A3 that extend radially from the rotation axis DA along respective arm axes LA1, LA2, LA3. Each applicator arm A1, A2, A3 is an essentially rectangular structure. The applicator arms A1, A2, A3 are separated from each other by a uniform angle, which for the case of three applicator arms, would be 120°.

Based on the handle applicator's rotation, each applicator arm A1, A2, A3, has a trailing side VS1, VS2, VS3 and a leading side RS1, RS2, RS3. A bow section 13.1, 13.2, 13.3 connects each leading side RS1, RS2, RS3 to a trailing side VS1, VS2, VS3 of an adjacent arm A1, A2, A3 that is ahead of it in the direction of rotation DR. In effect, each pair of arms defines an angle in which the bow section 13.1, 13.2, 13.3 is a rounded vertex, or sulcus.

Figure 1B:
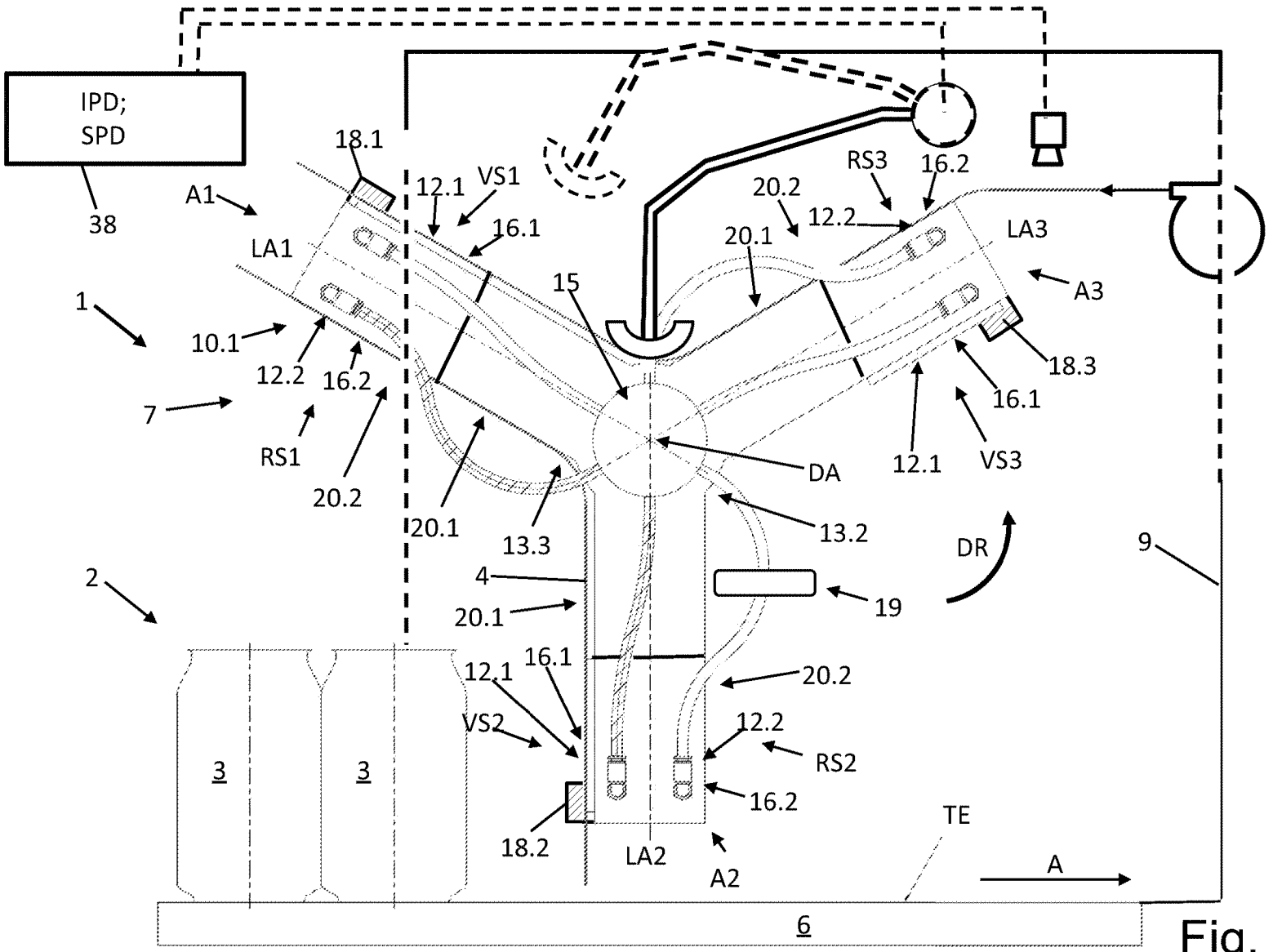

As shown in FIG. 1*b*, each arm A1, A2, A3 has a corresponding engager 10.1, 10.2, 10.3. The engager 10.1, 10.2, 10.3 is a holding and/or pressing device.

Figure 5:
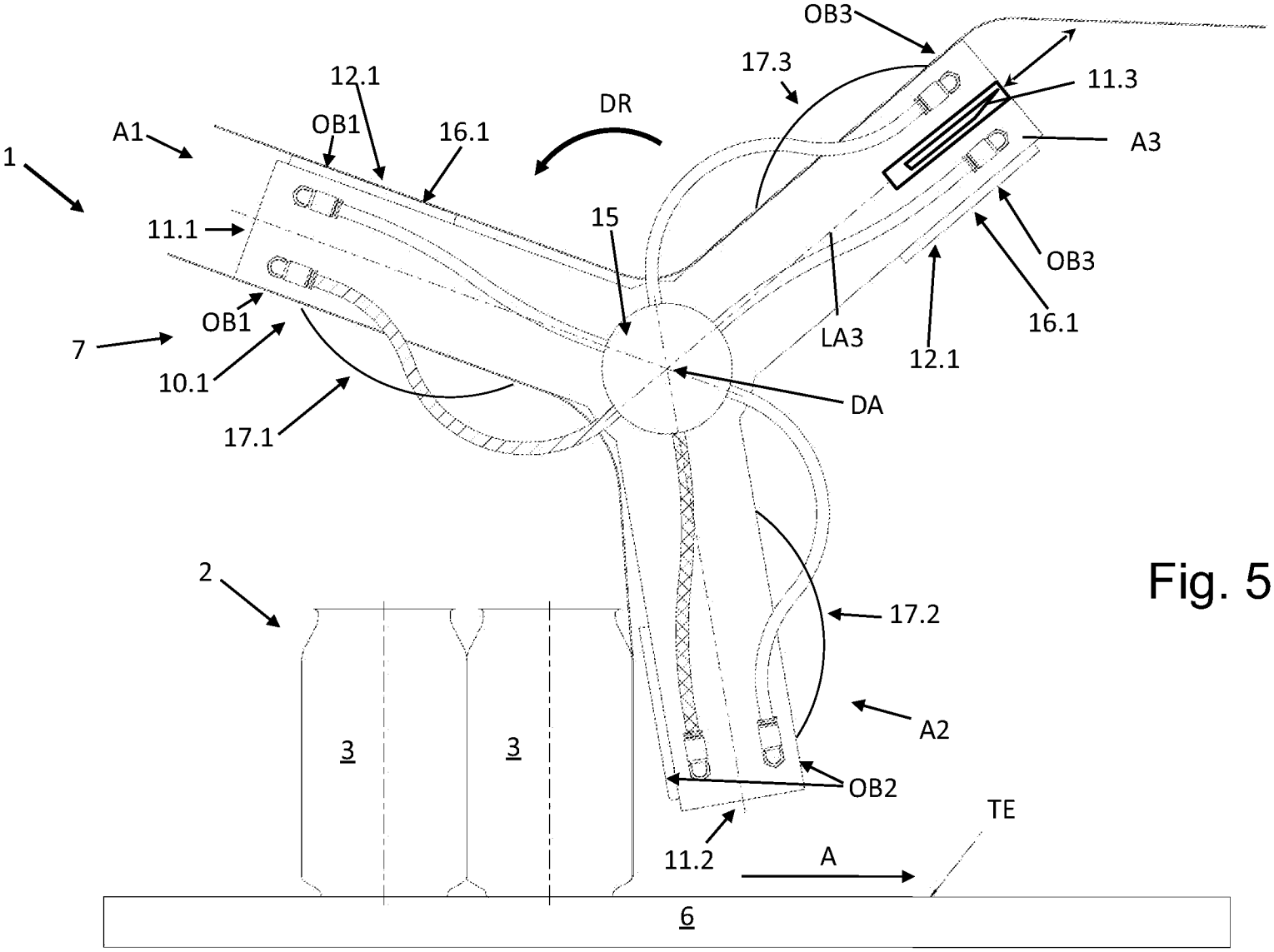

In addition, each arm A1, A2, A3 has a corresponding cutter 11.1, 11.2, 11.3. A suitable cutter 11.1, 11.2, 11.3 comprises a controllable and retractable blade. FIG. 5 shows the cutting tool 11.3 for the applicator arm A3 by way of example. The cutting tool 11.3 moves linearly in the axial direction LA3 and serves to cut through the band when the band is tensioned over the end surfaces of the respective applicator arm A3.

The engager 10.1, 10.2, 10.3 and the cutter 11.1, 11.2, 11.3 cooperate to draw a length from an endless band over the bundle 2, to cut it to the length needed to form a handle 4, and to press the resulting handle 4 onto the bundle 2 such that the handle's self-adhesive portion attaches to the bundle 2.

Each engager 10.1, 10.2, 10.3 includes first and second suction regions 12.1, 12.2. The first suction region 12.1 is on an arm's trailing side VS1, VS2, VS3. The second suction region 12.2 is on that arm's leading side RS1, RS2, RS3. It should be noted that although these are referred to as "suction regions," during some operating steps, an overpressure will be applied. However, since the difference between underpressure and overpressure is a matter of the suction's direction, the name is entirely appropriate.

The first suction region 12.1 is an opening in a first plate-shaped format part 16.1 on the trailing side VS1, VS2, VS3 in the region of the engager 10.1, 10.2, 10.3. Similarly, the second suction region 12.2 is an opening in a second plate-shaped format part 16.2 on the corresponding leading side RS1, RS2, RS3 of the engager 10.1, 10.2, 10.3. The second format part 16.2 is preferably made from an elastic material or a foam that engages the endless band, guides it, engages the handle 4 that has been cut from the band, and then presses that handle 4 onto the bundle 2.

Whenever an applicator arm A1, A2, A3 contacts a bundle 2, the resulting impact may damage the bundle 2. To dampen this impact, an arm's leading side RS1, RS2, RS3 comprises a spring plate 17.1, 17.2, 17.3, best seen in FIG. 5. The spring plate 17.1, 17.2, 17.3 is cambered away from the arm's axis LA1, LA2, LA3. As a result, upon impact, the spring plate 17.1, 17.2, 17.3 absorbs some of the kinetic energy and converts it into potential energy.

Referring back to FIG. 1*b*, each arm A1, A2, A4 includes a motion sensor 18.1, 18.2, 18.3 at its trailing side VS1, VS2, VS3. The arm's motion sensor 18.1, 18.2, 18.3 detects movement of a bundle 2 against that arm A1, A2, A3. This provides a feedback signal for controlling rotation of the handle applicator 7. In some embodiments, the motion sensor 18.1, 18.2, 18.3 is a force sensor or a contact sensor.

In addition, the handle applicator 7 features a location sensor 19 disposed between the transport plane TE and the axis of rotation DA. The location sensor 19 detects the location or rotational angle associated with each arm A1, A2, A3.

The handle-attaching machine 1 also includes a pneumatic-pressure distributor 15. The pneumatic-pressure distributor 15 provides different pneumatic pressure to the suction regions 12.1, 12.2. These pneumatic pressure levels depend on the handle applicator's position. Among the pneumatic pressure levels is an overpressure and an underpressure, which can also be referred to as "positive pressure" and "negative pressure." An overpressure is greater than atmospheric pressure and underpressure is less than atmospheric pressure.

The band, and hence the handle 4 made from the band, includes certain position markings PM. These are pressure marks, length marks, and/or cutting marks. A handle 4 includes at least one such position marking PM. Actual-position data IPD indicates the actual position of a position marking PM on a handle 4. These position markings PM are useful to ensure that the adhesive portion of the handle 4 is what contacts the bundle 2.

Figure 6:
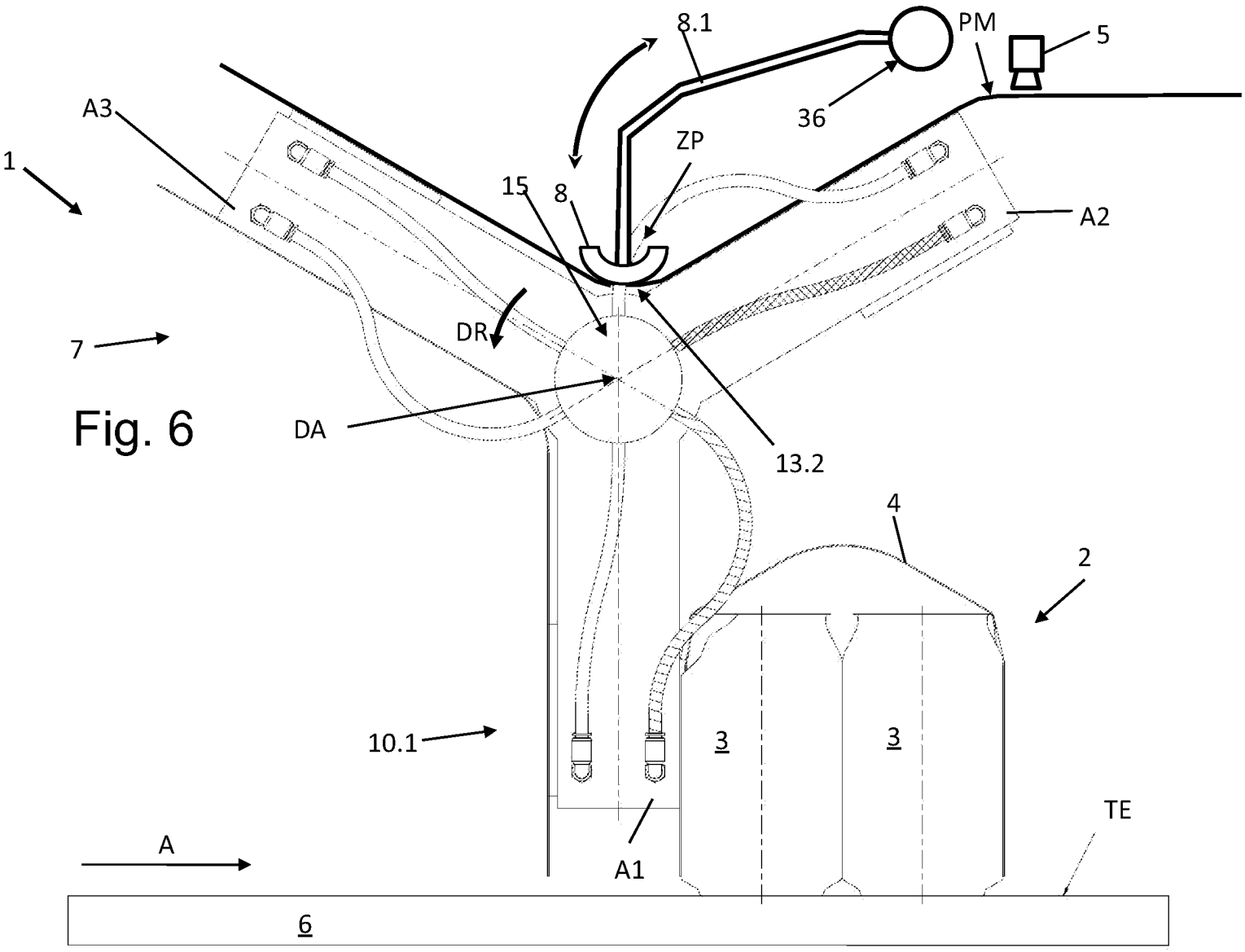
Figure 7:
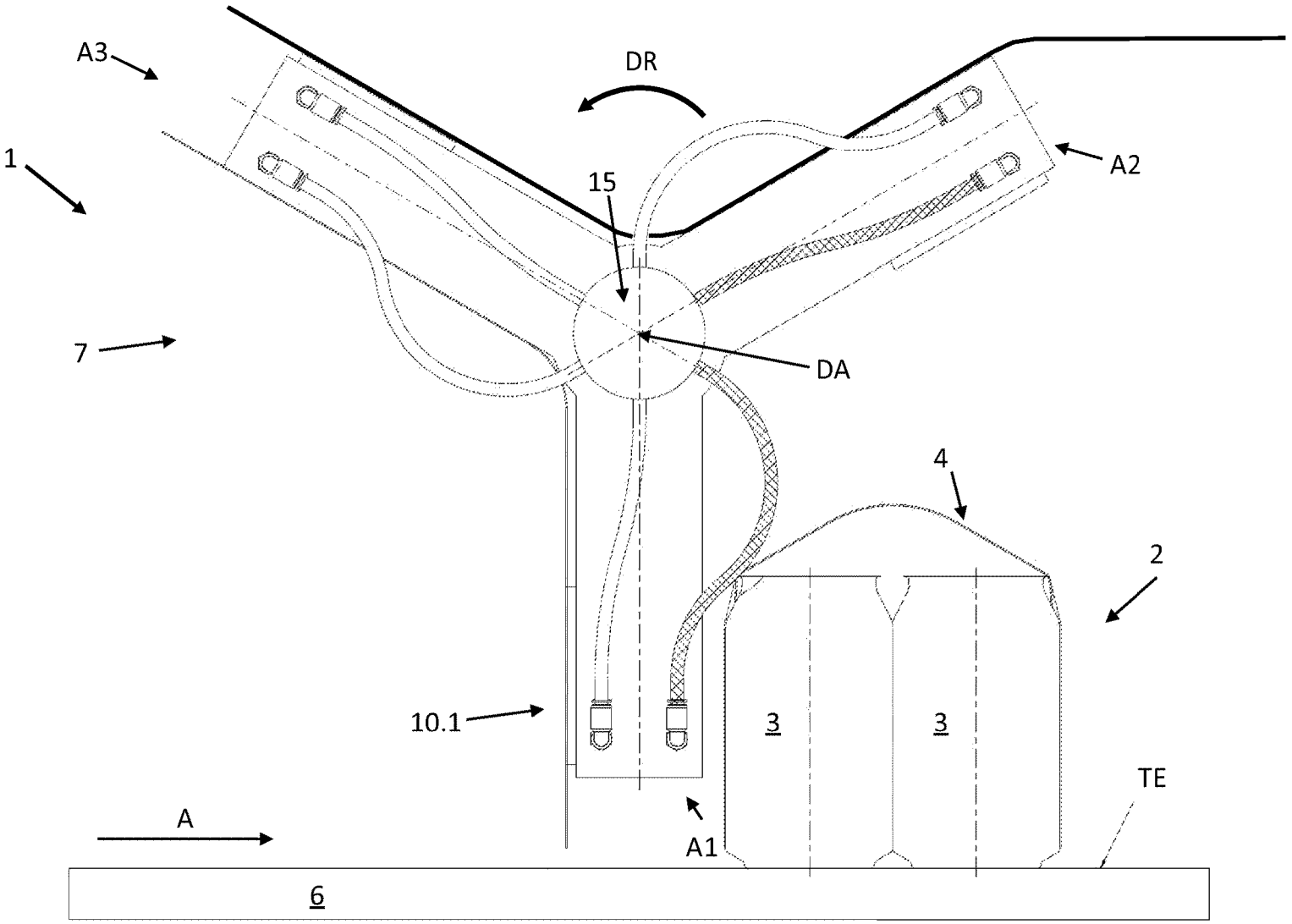

Referring now to FIG. 6, a mark detector 5 detects the position markings PM on the handle 4 to determine actual-position data IPD. The mark detector 5 is preferably an optical detector, such as a video camera. In some embodiments, the mark detector 55 is a fixed-position detector.

Information from the mark detector 5 is used to cause a contact-body driver 36 to move a contact body 8 along a continuum of angles between a release position FP and a drawing position ZP. Such movement can take place in multiple steps or in one smooth movement with no steps.

The contact-body driver 36 is thus able to move the contact body 8 to any intermediate position between the contact body's release position FP and its drawing position ZP during the operation of the handle-attaching machine 1. This is useful to compensate for small changes that may occur in the length of the handle 4, for example as a result of the band stretching. By moving the contact body 8, it is possible to adjust the contact body's drawing position ZP as a function of actual-position data IPD detected by the mark detector 5 to ensure that the correct portion of the handle 4 ultimately makes contact with the correct portion of the bundle 2.

A control line 37 connects a controller 38 to both the contact-body driver 36 and the mark detector 5. This enables the controller 38 to control the contact-body driver 36 in response to feedback information provided by the mark detector 5 so as to control or regulate location of the handle's position mark PM based on the actual-position data IPD detected by the mark detector 5. The controller 38 uses this to move the contact body 8 to an appropriate location between the release position FP and the drawing position ZP. In some embodiments, the contact-body driver 36 is stepping motor, such as a servomotor.

The controller 38 generates a control signal to cause the contact-body driver 36 to adjust the contact body's position between the release position and the drawing position ZP to reduce a deviation between the actual position data IPD and reference position data SPD.

The contact body 8 is disposed at a distal end of a lever arm 8.1 that is angled by the contact-body driver 36 in such a way that the applicator arms A1, A2, A3 can be guided past the contact body 8 when the contact body 8 is in the release position FP. To assist with this, the contact-body driver 36 produces a linear movement, and in particular, a linear pivoting movement, of the contact body 8. Preferably, the contact body's pivoting movement is synchronous with the arm's rotation.

Figure 2A:
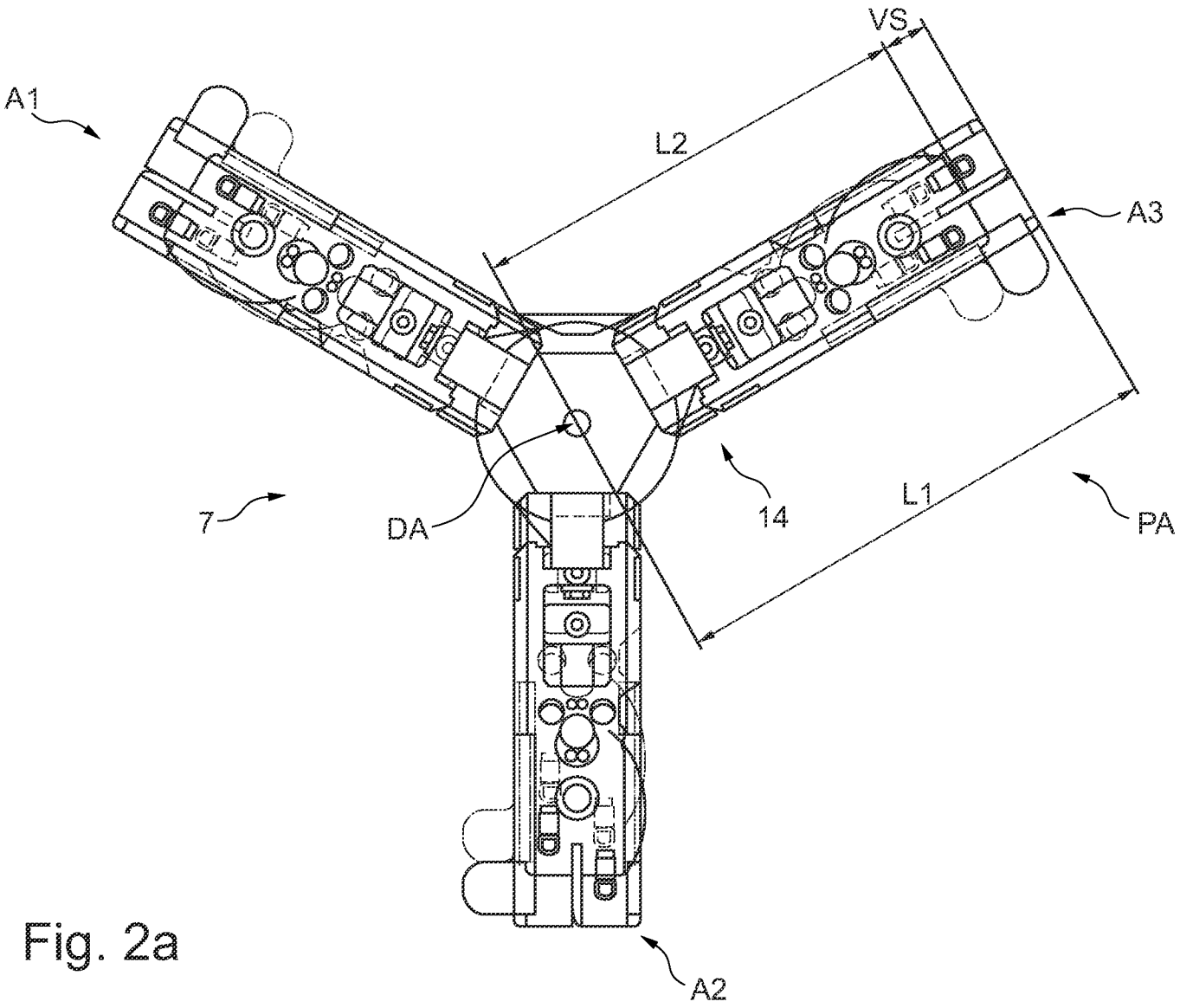
FIGS. 2*a* and 2*b* in each case, a schematic view of an exemplary carrying handle applicator unit, in a retracted position as well as in an extended position.
Figure 2B:
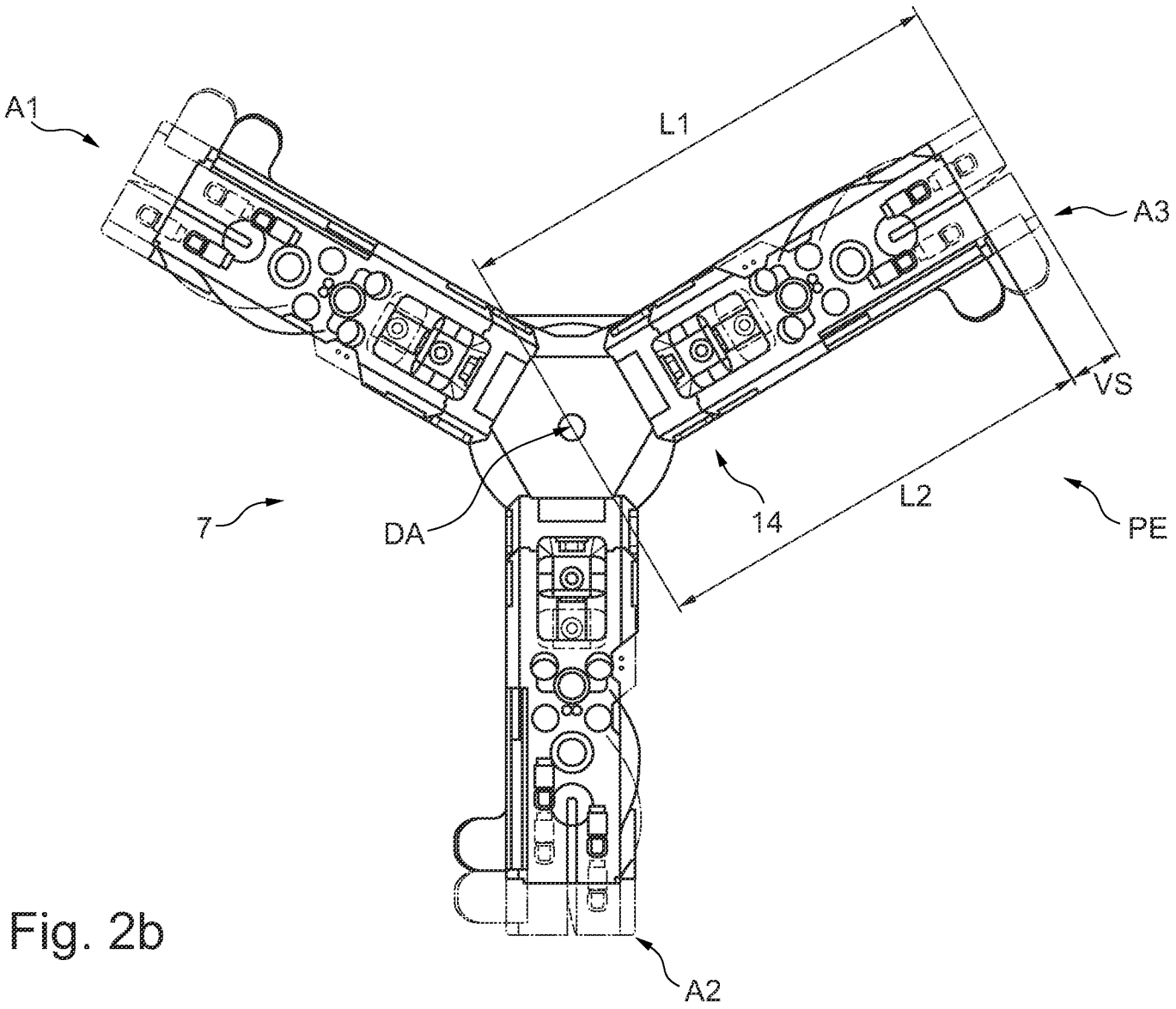
Figure 3B:
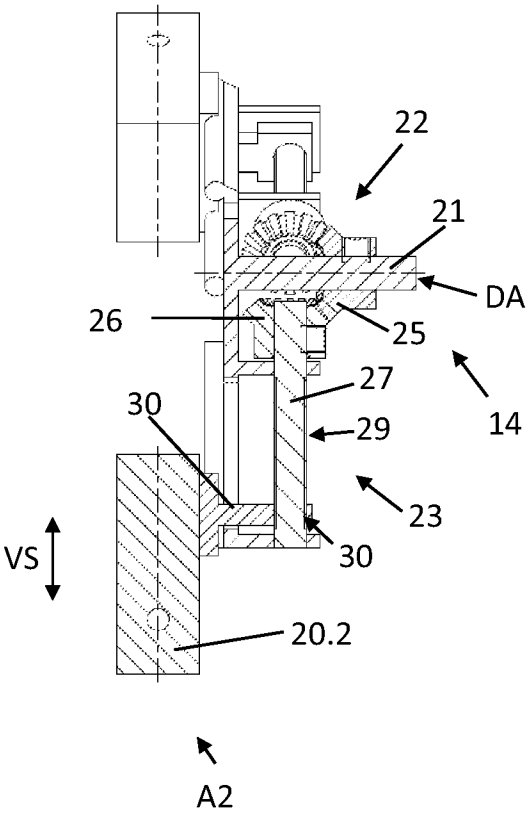
FIGS. 3*a* and 3*b* in each case, a schematic view of a function representation of a movement device of a carrying handle applicator unit.
Figure 3A:
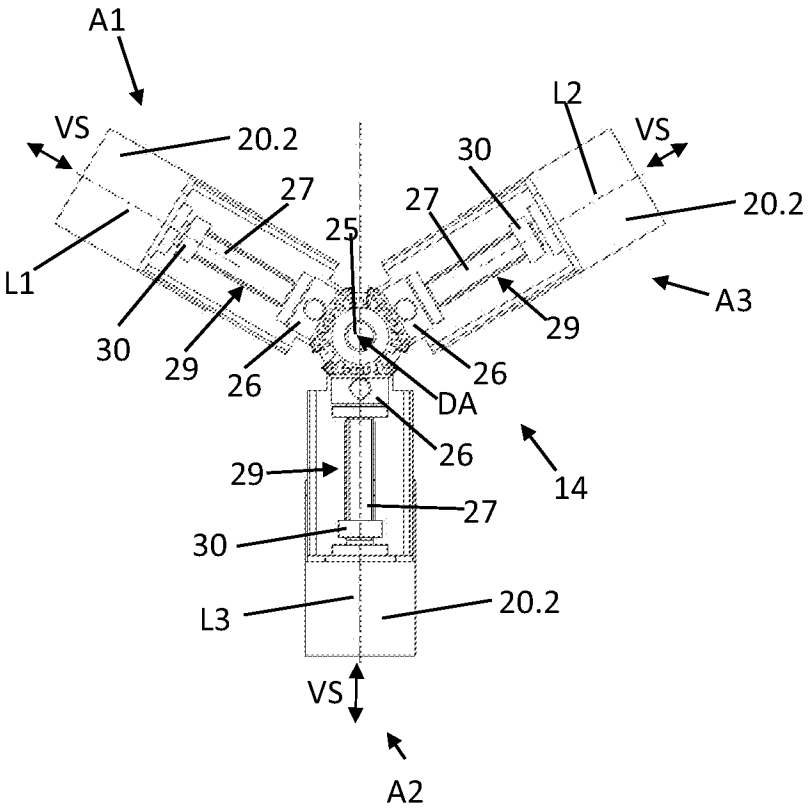

Referring now to FIGS. 2*a*, 2*b*, and 3*a*, some embodiments feature a movement device 14 that moves along an arm's axis LA1, LA2, LA3 so as to configure an engager's suction region 12.1, 12.2. This makes it possible to change both the range over which suction occurs along the arms' longitudinal axes LA1, LA2, LA3 and the location at which suction occurs relative to the transport plane TE. The movement device 14 carries out this adjustment mechanically, and preferably electromechanically, using a motor that is controlled and/or regulated.

The movement device 14 moves an arm's suction region 12.1, 12.2 between a first length L1 and a second length L2, the latter being the shorter of the two, as shown in FIG. 2*a*. This results in a differential length VS that corresponds to an adjustment extent. In either case, the length is that between the rotation axis DA and the arm's distal end. In typical embodiments, this differential length VS is between one and five centimeters. For many bundles 2, the differential length VS is between three and ten centimeters. In still other embodiments, the differential length VS is about five centimeters.

In some embodiments, the movement device 14 moves the arm's engager 10.1, 10.2, 10.3 and also the suction region 12.1, 12.2 associated with it, along the arm's axis LA1, LA2, LA3.

In such embodiments, as can be seen in FIG. 1*b*, the arm A1, A2, A3 comprises proximal and distal arm-elements 20.1, 20.2. The movement device 14 moves the distal arm-element 20.1 relative to the proximal arm-element 20.1 along the arm's axis LA1, LA2, L3. The arm's engager 10.1, 10.2, 10.3, with its associated suction region 12.1, 12.2, is arranged on the outside of the distal arm element 20.2.

The movement device 14 moves an arm's distal arm-element 20.2 between a retracted position PE and an extended position PA, relative to its corresponding proximal arm element 20.1. In its retracted position PE, the arm assumes the second length L2. In its extended position PR, the arm assumes the first length L1.

In a preferred embodiment, the movement device 14 moves the distal arm-element 20.2 along a continuum of positions between the retracted position PE and the extended position PA so that the arm is able to assume any intermediate length between the first and second lengths L1, L2.

Referring now to FIG. 3*b*, the movement device 14 comprises a motor-driven shaft 21 that drives an angle gear 22. Rotation of this angle gear 22 by the motor-drive drive shaft 21 rotates a worm gear 23. This rotation translates the distal arm-element 20.2 between its retracted and extended positions PE, PA.

As shown in FIG. 3*a*, the movement device 14 interacts with all of the arms A1, A2, A3. This is carried out using a first toothed wheel 25 that is coupled to the motor-driven shaft 21 to drive three further gear wheels 26, each of which is coupled to a corresponding drive shaft 27 that is perpendicular to the motor-driven shaft 21.

Each drive shaft 27 includes a threaded section 29 of a worm gear 23. The threaded section 29 extends along the arm's longitudinal axis LA1, LA2, LA3 on the side opposite the corresponding toothed wheel 26. The threaded section 29 enables a movement carriage 31 to be translated along the arm's longitudinal axis LA1, LA2, LA3. This movement carriage 31 is permanently coupled to a corresponding distal arm-element 20.2 by a threaded nut 30, as shown in FIG. 3*b*.

The worm gear 23 is configured such that the threaded section 29 takes up the drive shaft's rotational movement. It is then transferred onto the threaded nut 30, which interacts with the movement carriage 31 in such a way that the movement carriage 31, together with the distal arm-element 20.2 that it carries, moves by the differential length VS. An initial rotation of the motor-driven shaft 21 is thus converted into sliding movement of the carriage 31 as a result of the intermediate engagement of the angle gear 21 and the worm gear 23.

In an alternative embodiment, as shown in FIGS. 3*a* and 3*b*, an angle gear unit initiates rotational movement and transfers it onto a spindle, or movement screw. A spindle nut, which is rigidly connected to the movement carriage 31, converts this into translation. A suitable angle gear unit comprises a central bevel gear and at least one additional bevel gear per arm A1, A2, A3.

In either case, the arms' adjustable lengths makes it possible to accommodate different handles 4 of different lengths.

Figure 8A:
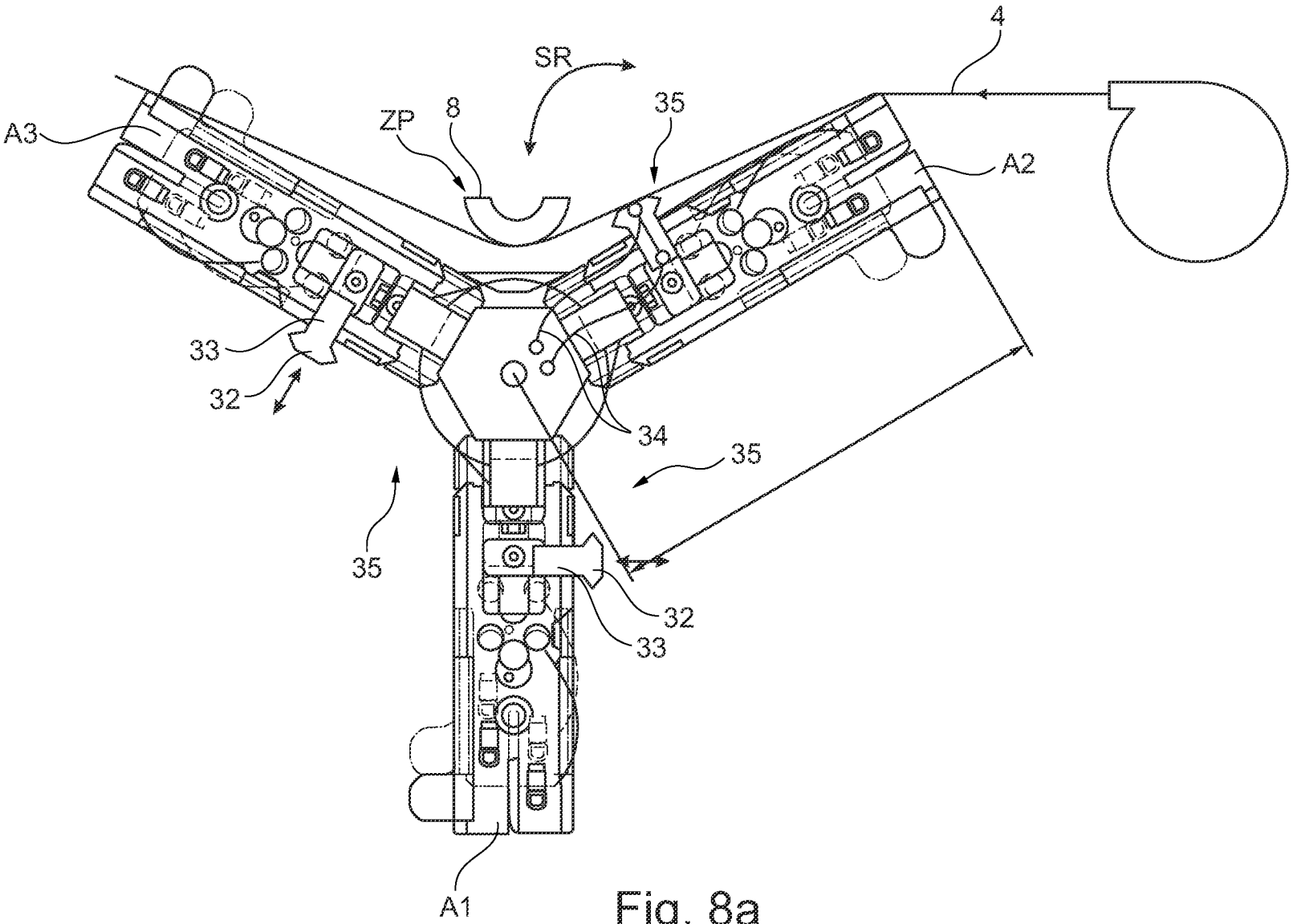
FIGS. 8*a* and 8*b* in a schematic side view, two exemplary embodiment variants of a suction pad in the bend of a carrying handle applicator unit.
Figure 8B:
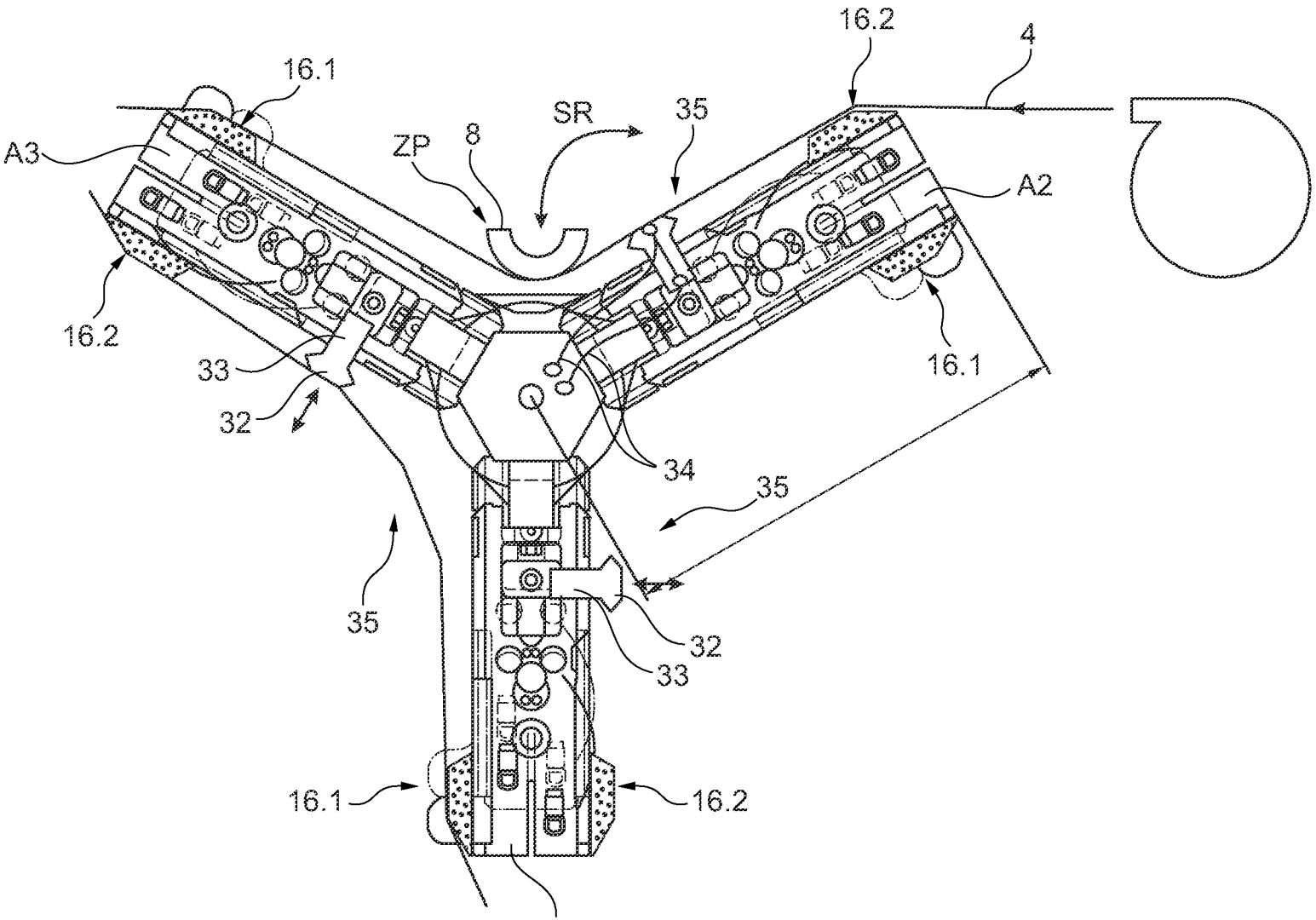

FIGS. 8*a* and 8*b* show an alternative embodiment that features a contact element 35 projecting by an adjustable extent from an arm's leading side RS1, RS2, RS3. This extent defines a height. Manipulating the projection's extent handle's camber when the handle 4 is attached to the bundle 2. Increasing the projection decreases the camber and decreasing the projection increases the camber.

The contact element 35 is spaced apart from the contact body 8 along an arm A1, A2, A3 such that it is possible for the contact body 8 to reach a height above the arm A1, A2, A3 that is below the height of the contact element's projection.

Each contact element 35 includes a suction opening 32 connected via a hose connection to pneumatic lines 34 that ultimately connect to the pressure distributor 15. These suction openings 32 permit the contact element 35 to engage the handle 4 by suction. As a result, the handle 4 is always securely held in position regardless of the contact body's activity.

In some embodiments, a suction-opening movement device 33 moves the suction opening 32 in a direction indicated by the double arrows. As a result, it is possible to adjust the suction device's position relative to the arm's suction region 12.1, 12.2 and/or to the rotation axis.

A motor, which is preferably mechanical or electromechanical, drives the suction-opening movement device 33. It does so in a controlled and/or regulated manner. Embodiments include those in which movement device 22 includes a pneumatic cylinder and those in which it is moved in the same manner described above in connection with the movement device 14.

In some embodiments, the suction opening 32 is subjected to different pneumatic-pressure levels, such as a negative pressure and a positive pressure, depending on its position, and in particular, on its rotational position.

In other embodiments, the contact element 35 is a purely mechanical structure with no connection to a pneumatic system. In such embodiments, moving fingers hold the handle to the contact element 35.

In still other embodiments, the contact element 35 is a format part. As such, it is not adjustable. Instead, it is installed at the time that it is needed and replaced by another contact element 35 is required.

In some embodiments, the pressure distributor 15 applies different pressures depending on the rotational position of the handle applicator 7. In such embodiments, it is useful to have valves assigned to corresponding suction openings 32. A suitable control system having a sensor controls these valves so as to either hold the handle or release it forcefully with a burst of overpressure.

The suction opening 32 is configured such as to maintain a defined position of the carrying handle 4 by holding it in the bend section 13.3 with a negative pressure in its low position. In addition to this, the suction opening 32, holds the handle 4, which is initially reintroduced over the ends of the two corresponding upright applicator arms A1, A2, A3 and tensioned horizontally, in a desired low position in contact with the bend section 13.1, 13.2, 13.3.

In FIG. 1*b*, the second applicator arm A2, which is holding a handle 4 that is about to be attached, has reached its vertical position. Engagers 10.1, 10.2, and in particular, suction regions 12.1, 12.2, hold the handle 4 by negative pressure.

A suction opening 32 at the bend section 13.3 applies negative pressure to hold the first handle 4. Alternative embodiments feature a finger that pivots into place to secure the handle 4. The adhesive sections on the free-ends of the handle 4 project as loose ends past the ends of the first and second applicator arms A1, A2.

Figure 4:
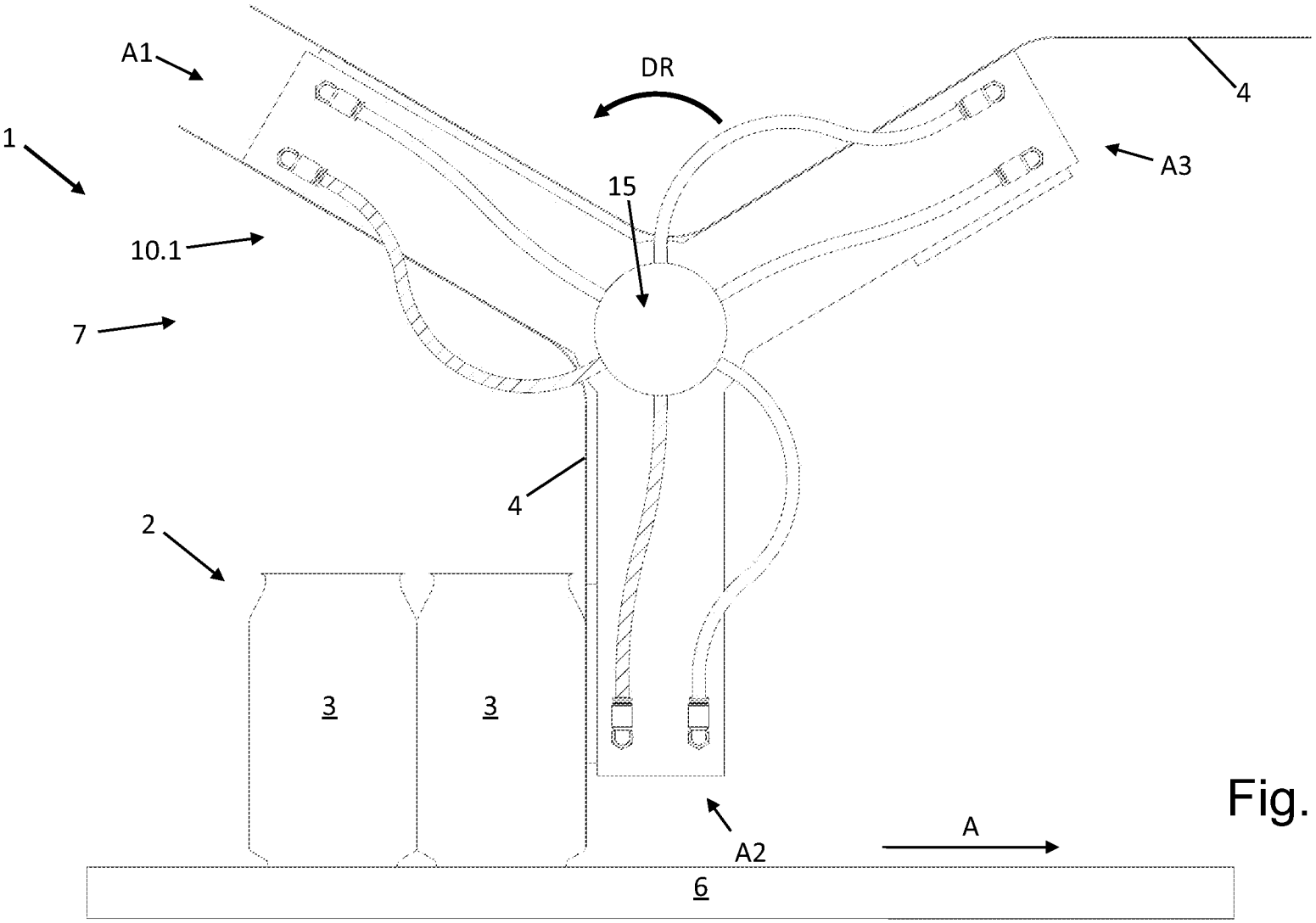
FIG. 4 to FIG. 7 in a schematic side view, an exemplary embodiment variant of a device according to the invention for attaching carrying handles to packaging means or groups of packaging means, in different operational states.

The self-adhesive side of the handle 4 points towards the downstream face of an approaching bundle 2. This bundle 2 comes in contact against the second applicator arm A2 and therefore against the self-adhesive free end of the carrying handle 4. As a result, it becomes fixed on the bundle's downstream face, as shown in FIG. 4. In a preferred embodiment, a pulse of overpressure delivered to the suction region 12.1 detaches the handle 4 from the engager 10.2.

At the same time that the arm A2 contacts the bundle 2, the motion sensor 18.2 generates a sensor signal. The handle applicator 7 then rotates further in the rotation direction DR, as shown in FIG. 5.

The handle applicator's rotation matches the bundle's transport speed in such a way that the first applicator arm A1 catches up with the upstream face of the bundle 2 and presses the other self-adhesive end of the handle 4 on the upstream face of the bundle 2, as shown in FIG. 6.

Meanwhile, the contact body 8, which was just above the second and third arms A2, A3, pivots down into its drawing position ZP to guide a newly-introduced handle 4 into the sulcus formed in the bend section 13.2 between the second and third arms A2, A3. The suction opening 32 then holds the handle 4 in this position by negative pressure. The mark detector 5, which is in the fixed-position detection range, detects actual-position data IPD of a position marking PM of the newly-introduced carrying handle 4 and provides that information to the controller 38. The controller 38 then compares it with the reference-position data SPD stored therein for position marking PM and generates a control signal to correct for any deviation. The control signal travels via the control line 37 to the contact-body driver 36, which in turn pivots the contact body 8 to whatever position between the release position FP and the drawing position ZP may be required to correct for such deviation.

Each bend section 13.1, 13.2, 13.3 has a corresponding suction opening 32, A brief burst of overpressure through that suction opening 32 releases the carrying handle 4 from the drawing position ZP.

In a preferred embodiment, a brief overpressure pulse at the first suction region 12.1 of the first arm's engager 10.1 during or after the pressing of the self-adhesive end of the handle 4 onto the bundle 2 detaches the handle 4 from the first engager 10.1. The bundle 2, with its attached handle 4, is then conveyed onward by the transport device 6 in the transport direction "A".

The invention has been described heretofore by way of exemplary embodiments. It is understood that a large number of modifications or derivations are possible, without thereby departing from the scope of protection defined by the claims.

The invention claimed is:

1. An apparatus for attaching handles to containers or bundles of containers that are conveyed on a transporter in a transport direction, said handles being self-adhering handles, wherein the apparatus comprises a base body, a handle applicator that is mounted above said transporter and is configured to be driven by a motor to rotate about a horizontal rotation axis that is transverse to said transport direction, said handle applicator comprising three arms that are radial to said rotation axis and that each extend along a longitudinal axis that intersects said rotation axis, a contact body that is mounted on said base body and is movable so as to interact with said handle applicator, said contact body being adjustable between a release position and a drawing position, wherein, in said contact body's release position, said handle applicator can be freely driven and wherein, in said contact body's drawing position, said contact body is brought into contact with an upper side of an endless band of material prior to said endless band being cut to form said handle, a contact-body driver configured to move said contact body along a continuum of positions between said release position and said drawing position based on actual position data indicative of actual positions of position markings on said handle, a controller that is configured to control said contact-body driver based at least in part on said actual position data, and a mark detector that detects said position markings and provides said data to said controller, wherein each of said arms comprises an engager and a cutter that cooperate to separate a handle from an endless band of material and to press self-adhesive portions at free ends of said handle onto said bundle to attach said handle to said bundle, each engager comprising a suction region that uses negative pressure to hold and to guide said band.

2. The apparatus of claim 1, wherein said contact-body driver is configured to temporarily move said contact body to an intermediate position during operation, said intermediate position being between said release position and said drawing position.

3. The apparatus of claim 1, wherein said contact-body driver comprises servomotor.

4. The apparatus of claim 1, wherein said mark detector comprises a video camera.

5. The apparatus of claim 1, wherein said controller is configured to compare said data indicative of actual position to reference position data stored in said controller and to generate a control signal to correct any deviation between them by actuating said contact-body driver to adjust said contact body's position.

6. The apparatus of claim 1, further comprising a lever arm that extends at an angle from said contact-body driver, wherein said contact body is disposed at a distal end of said lever arm, and wherein said lever arm holds said contact body in said release position such that said handle applicator is freely rotatable.

7. The apparatus of claim 1, wherein contact-body driver is configured to cause pivoting movement of said contact body.

8. The apparatus of claim 1, wherein contact-body driver is configured to cause pivot said contact body synchronously with rotation of said handle applicator.

9. The apparatus of claim 1, wherein each of said arms comprises a contact element that protrudes from a leading side thereof, thereby defining a protrusion extent, wherein said contact element and said contact body are spaced apart along said arm such that said contact body moves closer to said arm than said position extent.

10. The apparatus of claim 1, wherein each of said arms comprises a contact element that comprises a suction opening for holding said handle by negative pressure, where said contact element protrudes from a leading side of said arm, thereby defining a protrusion extent, wherein said contact element and said contact body are spaced apart along said arm such that said contact body moves closer to said arm than said position extent.

11. The apparatus of claim 1, further comprising a movement device configured to move said suction region along said longitudinal axis of at least one of said arms.

12. The apparatus of claim 1, further comprising a movement device configured to move said suction region along said longitudinal axis of at least one of said arms to be between a first length and a second length.

13. The apparatus of claim 1, further comprising a movement device configured to move said engagers along longitudinal axes of said arms.

14. The apparatus of claim 1, further comprising a movement device, wherein each of said arms comprises a distal arm-element and a proximal arm-element, wherein said movement device is configured to move said distal arm-element along a longitudinal axis of said arm and wherein said section region is disposed on said distal arm-element.

15. The apparatus of claim 1, further comprising a movement device. wherein, for each of said arms, said movement device moves a distal arm-element of said arm along said longitudinal axis of said arm such that said arm is between first length and a second length.

16. The apparatus of claim 1, further comprising a movement device, wherein, for each of said arms, said movement device moves a distal arm-element of said arm along said longitudinal axis of said arm such that said arm is between first length and a second length, wherein said arm is operable along all of said lengths.

17. The apparatus of claim 1, further comprising a drive shaft, an angle gear and a worm gear, wherein said angle gear and said worm gear cooperate to convert rotation of said drive shaft into translation of a distal arm-element of each of said arms.

18. A method of attaching self-adhesive carrying handles to bundles of containers that are being conveyed by a transporter along a transport direction, said carrying handles having been cut from an endless band that has sections that have an adhesive layer, wherein attaching said handles comprises causing rotation of a handle applicator that is mounted on a base body above said transporter and is configured to be driven by a motor to rotate about a horizontal rotation axis that is transverse to said transport direction, said handle applicator comprising three arms that are radial to said rotation axis and that each extend along a longitudinal axis that intersects said rotation axis, causing an engager and a cutter at each of said arms to cooperate to separate a handle from an endless band of material and to press self-adhesive portions at free ends of said handle onto said bundle to attach said handle to said bundle, each engager comprising a suction region that uses negative pressure to hold and to guide said band, using a mark detector to detect position markings on said handle, moving a contact body that is mounted on said base body so as to interact with said handle applicator, said contact body being adjustable between a release position and a drawing position, wherein, in said release position, said handle applicator can be freely driven and wherein, in said drawing position, said contact body is brought into contact with an upper side of an endless band of material prior to said endless band being cut to form said handle, wherein moving said contact body comprises actuating a contact-body driver configured to move said contact body along a continuum of positions between said release position and said drawing position based on actual position data indicative of actual positions of position markings on said handle.

19. The method of claim 18, further comprising moving said contact body to a position that depends on actual position data of said position markings as detected by said mark detector, wherein moving said contact body comprises moving said contact body in steps to a position that is along a continuum of positions that are between said release position and said drawing position.

* * * * *